US008196779B1

(12) United States Patent
Czarnecki

(10) Patent No.: US 8,196,779 B1
(45) Date of Patent: Jun. 12, 2012

(54) DISPENSER FOR A LIQUID IN A CONTAINER AND FOR MOUNTING TO DIFFERENTLY CONFIGURED PLACES

(76) Inventor: Vincent Czarnecki, West Islip, NY (US)

( * ) Notice: Subject to any disclaimer, the term of this patent is extended or adjusted under 35 U.S.C. 154(b) by 717 days.

(21) Appl. No.: 12/378,551

(22) Filed: Feb. 17, 2009

(51) Int. Cl.
*B67D 7/06* (2010.01)

(52) U.S. Cl. ..... 222/185.1; 222/181.1

(58) Field of Classification Search ..... 222/185.1, 222/181.1–181.3, 83.5, 88, 89, 325, 129, 222/129.1, 180, 184, 186
See application file for complete search history.

(56) References Cited

U.S. PATENT DOCUMENTS

| | | | | | |
|---|---|---|---|---|---|
| 3,042,267 | A | * | 7/1962 | Reynard | 222/185.1 |
| 3,086,683 | A | * | 4/1963 | Loper | 222/183 |
| 4,138,092 | A | * | 2/1979 | Apellaniz | 251/325 |
| 4,386,718 | A | * | 6/1983 | Stewart et al. | 222/185.1 |
| 4,646,944 | A | * | 3/1987 | Sanderson | 222/108 |
| 4,664,297 | A | | 5/1987 | Giovinazzi | |
| 4,722,463 | A | * | 2/1988 | Anderson | 222/185.1 |
| 4,747,520 | A | | 5/1988 | Lane, Sr. | |
| 4,844,290 | A | * | 7/1989 | McCurdy et al. | 222/185.1 |
| 4,911,334 | A | | 3/1990 | Kedzierski | |
| 5,024,353 | A | * | 6/1991 | Horne | 222/185.1 |
| 5,351,861 | A | | 10/1994 | Jovellana | |
| 5,509,583 | A | | 4/1996 | Dolson | |
| 5,826,755 | A | | 10/1998 | Burd | |
| 6,241,126 | B1 | | 6/2001 | Goodman | |
| 6,540,111 | B2 | | 4/2003 | Sunnarborg | |
| 6,820,772 | B1 | | 11/2004 | Bennett, Jr. | |
| 6,892,903 | B1 | | 5/2005 | Bartolotta | |
| 7,472,807 | B1 | * | 1/2009 | Black | 222/185.1 |

* cited by examiner

*Primary Examiner* — Lien Ngo
(74) *Attorney, Agent, or Firm* — Richard L Miller

(57) ABSTRACT

A dispenser for a liquid in a container and for mounting to differently configured places. The dispenser includes a support, a valve body, and a mount. The support supports the container in an inverted position. The valve body is operatively connected to the support and dispenses the liquid from the container while simultaneously venting air to control flow of the liquid through the dispenser. The mount is operatively connected to the support and mounts the dispenser to the differently configured places.

10 Claims, 5 Drawing Sheets

DISPENSER FOR A LIQUID IN A CONTAINER AND FOR MOUNTING TO DIFFERENTLY CONFIGURED PLACES

1. BACKGROUND OF THE INVENTION

A. Field of the Invention

The embodiments of the present invention relate to a dispenser for liquids, and more particularly, the embodiments of the present invention relate to a dispenser for a liquid in a container and for mounting to differently configured places.

B. Description of the Prior Art

Numerous innovations for bottle dispensers have been provided in the prior art that will be described below in chronological order to show advancement in the art, and which is incorporated herein by reference thereto. Even though these innovations may be suitable for the specific individual purposes to which they address, however, they differ from the present invention in that they do not teach a dispenser for a liquid in a container and for mounting to differently configured places.

(1) U.S. Pat. No. 4,664,297 to Giovinazzi.

U.S. Pat. No. 4,664,297 issued to Giovinazzi on May 12, 1987 in U.S. class 222 and subclass 185 teaches a beverage dispenser, particularly for home refrigerators, including a one-piece cradle that can support one or more large beverage bottles in an inclined mode to promote gravity discharge of the beverage. A dispensing valve can be directly coupled with the threaded necks of larger size bottles and with a threaded adapter can be coupled with the neck of a smaller size bottle. A vent tube connected with the dispensing valve extends deeply into the beverage bottle to avoid an air lock therein impeding flow through the valve. A pivoted valve operating lever, when moved to the valve opening beverage dispensing position against a spring force, simultaneously opens the vent tube to atmosphere. When the lever is released to cause closing of the dispensing valve, an extension of the lever effects closing and sealing of the vent tube.

(2) U.S. Pat. No. 4,747,520 to Lane, Sr.

U.S. Pat. No. 4,747,520 issued to Lane, Sr. on May 31, 1988 in U.S. class 222 and subclass 181 teaches a device for allowing liquid to be easily dispensed from a bottle having a mouth and an outwardly extending flange located adjacent the mouth. A stand is supported on a support surface. A body is attached to the upper end of the stand. The body has a bore therethrough for allowing liquid from the bottle to pass therethrough. A dispensing valve is associated with the bore for controlling the passage of liquid from the bottle through the bore. A clamp is attached to the body for engaging and clamping the flange of the bottle to the body, with the mouth of the bottle communicating with the inlet end of the bore.

(3) U.S. Pat. No. 4,911,334 to Kedzierski.

U.S. Pat. No. 4,911,334 issued to Kedzierski on Mar. 27, 1990 in U.S. class 222 and subclass 185 teaches a beverage dispenser for dispensing carbonated beverages from bottled beverages. The dispenser includes a bottle holder for holding bottles in an inverted position and a dispensing valve that screws onto each bottle neck in place of its standard cap closure. The dispensing valve has two passages, namely, a vent passage to decompress the beverage in the bottle just before its discharging of the beverage, and a second discharging passage for the discharging of beverage therefrom. The passages are closed by the insertion of plungers into each of the passages far enough to seal the passages. The plungers are attached to a slide so as to simultaneously move the plungers together. The outside edges of the passages are offset so as to permit during the opening stroke, the vent passage to open first. The slide and its attached plungers are pushed to close or pulled to open the passages by a hand operated lever that rotates around a fulcrum point under finger pressure. In the closed position, the force from pressure inside the bottle against the plungers is transferred onto the lever so as to maintain the lever in the closed position. The bottle holder is suitably equipped with a lid for insulation and a handle extending through the lid to carry the beverage dispenser with the dispensing bottles inside.

(4) U.S. Pat. No. 5,351,861 to Jovellana.

U.S. Pat. No. 5,351,861 issued to Jovellana on Oct. 4, 1994 in U.S. class 222 and subclass 144 teaches a rotary beverage dispensing device including a turntable having an upstanding partition structure forming chambers facing away from the turntable rotational axis and a beverage container support mechanism in each chamber. Each beverage container has a downwardly directed discharge spout, and a shut-off valve to control flow of liquid beverage through the spout. The dispensing device is especially designed for carbonated beverages and fruit juices, and enables the user to select different beverages for dispensing, depending on individual preference.

(5) U.S. Pat. No. 5,509,583 to Dolson.

U.S. Pat. No. 5,509,583 issued to Dolson on Apr. 23, 1996 on U.S. class 222 and subclass 185.1 teaches a stand holding a bottle in an inverted position and a spigot having a female threaded connector is attached to the bottle. A horizontal stem extends from the connector to a valve. The spigot includes an air intake tube extending from the valve through the stem to a position near the bottom of the bottle, and an output tube extending from the valve through the stem to a position near the top of the bottle. The valve opens and closes the intake tube and the output tube concurrently. The stand includes a frusto-conical lower section, with an upper surface. The stem rests upon the upper surface of the lower section of the stand. The stand also includes a frusto-conical upper section with a slot for receiving the stem.

(6) U.S. Pat. No. 5,826,755 to Burd.

U.S. Pat. No. 5,826,755 issued to Burd on Oct. 27, 1998 in U.S. class 222 and subclass 309 teaches a dispenser for dispensing charges of a liquid from a container having a neck and a mouth at the end of the neck operable with the container in an inverted position for dispensing a charge of liquid. The dispenser includes a container holder for being mounted on a wall at one side of the holder constituting the back of the holder having a bottom with an opening therein for holding a container in an inverted position with its neck extending down through the opening. The dispenser further includes a member for being selectively pushed by hand toward the back of the holder or pulled by hand toward the front of the holder for actuating the dispenser. The actuator is selectively engageable with the container and with the holder in a first position for pushing the member toward the back of the holder to actuate the dispenser and in a second position for pulling the member toward the front to actuate the dispenser.

(7) U.S. Pat. No. 6,241,126 B1 to Goodman.

U.S. Pat. No. 6,241,126 B1 issued to Goodman on Jun. 5, 2001 in U.S. class 222 and subclass 185.1 teaches a desktop beverage dispenser including a base that holds an inverted bottle of a chosen beverage. The bottle of the chosen beverage can be screwed into a concave threaded inlet that is on top of the base. The concave threaded inlet is above the lever and valve assembly within the base. The lever and the valve assembly controls the flow of the beverage from the bottle into a desired container, such as a cup. The cup is slid into the bottom of the base underneath the lever and valve assembly where the cup is garaged for the beverage to be dispensed therein.

(8) U.S. Pat. No. 6,540,111 B2 to Sunnarborg.

U.S. Pat. No. 6,540,111 B2 issued to Sunnarborg on Apr. 1, 2003 in U.S. class 222 and subclass 129 teaches a bottled soda dispenser for dispensing soda from a 2-liter bottle without having to remove the cap each time allowing for one hand dispensing and keeping the carbonation in the bottle. The dispenser includes the base, a bottle holder, a valve system, and actuating levers. An air inlet having a check valve provides sufficient air in the bottle as the soda is withdrawn.

(9) U.S. Pat. No. 6,820,772 B1 to Bennett, Jr.

U.S. Pat. No. 6,820,772 B1 issued to Bennett, Jr. on Nov. 23, 2004 in U.S. class 222 and subclass 185.1 teaches a beverage dispenser including a support structure, a first tube secured to the support structure, a connector secured to one end of the first tube, and a valve secured to another end of the tube. The connector has an opening therethrough so as to be in communication with the first tube. The connector is secured to a beverage container so that the opening is in communication with the interior of the beverage container to allow the beverage to flow through the first tube and through an open valve. The connector includes first and second inside threads to selectively connect to outside threads of a respective smaller or larger beverage container.

(10) U.S. Pat. No. 6,892,903 B1 to Bartolotta.

U.S. Pat. No. 6,892,903 B1 issued to Bartolotta on May 17, 2005 in U.S. class 222 and subclass 185.1 teaches a beverage dispenser for mating with a bottle containing liquid contents and having a top, a mouth at the top, a bottom, and an upper portion. The dispenser includes a base having side walls, a top, a cradle, and intermediate plates extending horizontally through the side walls. A pipe has an inlet end centrally located above the intermediate plate and internal threading for accommodating and securing to the mouth of the bottle, and an outlet end extending horizontally from the base and having a spout. The cradle plate has a central opening that is substantially concentric with the inlet end and supports the bottle at its upper portion. The beverage dispenser is inverted to fasten the mouth of the bottle to the inlet end and then is turned 'right-side-up' to invert the bottle and allow the contents of the bottle to be easily dispensed through the spout.

It is apparent that numerous innovations for bottle dispensers have been provided in the prior art that are adapted to be used. Furthermore, even though these innovations may be suitable for the specific individual purposes to which they address, however, they would not be suitable for the purposes of the embodiments of the present invention as heretofore described, namely, a dispenser for a liquid in a container and for mounting to differently configured places.

2. SUMMARY OF THE INVENTION

Thus, an object of the embodiments of the present invention is to provide a dispenser for a liquid in a container and for mounting to differently configured places, which avoids the disadvantages of the prior art.

Briefly stated, another object of the embodiments of the present invention is to provide a dispenser for a liquid in a container and for mounting to differently configured places. The dispenser includes a support, a valve body, and a mount. The support holds the container in an inverted position. The valve body is operatively connected to the support and dispenses the liquid from the container while simultaneously venting air to allow smooth flow of the liquid through the dispenser. The mount is operatively connected to the support and mounts the dispenser to the differently configured places.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

Figure 1:
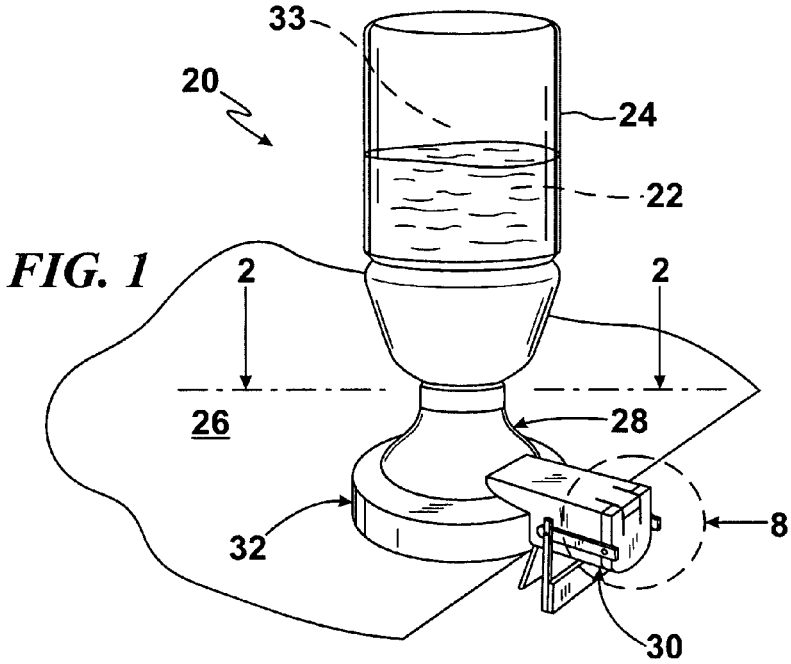
FIG. 1 is a diagrammatic perspective view of the dispenser of the embodiments of the present invention.

A. General.

20 dispenser of embodiments of present invention for liquid 22 in container 24 and for mounting to differently configured places 26

22 liquid in container 24

24 container

26 differently configured places

B. Overall Configuration of Dispenser 20.

28 support for supporting container 24 in inverted position

30 valve body for dispensing liquid 22 from container 24 while simultaneously venting air 33 to control flow of liquid 22 through dispenser 20

32 mount for mounting dispenser 20 to differently configured places 26

33 air

C. Specific Configuration of Support 28, Valve Body 30, and Mount 32.

34 dispensing chamber of valve body 30 for dispensing liquid 22
36 venting chamber of valve body 30 for venting air 33
40 partition of valve body 30
42 base of mount 32 for mounting dispenser 20 to differently configured places 26
44 plurality of concentric threaded rings of support 28 for threadably receiving threads of container 24 so as to accommodate different sized containers 24
46 first through bore of support 28
48 straw of support 28 for extending into container 24 for venting air 33
50 second through bore of support 28
52 distal end of valve body 30
54 door of valve body 30
56 pivot pin of valve body 30
57 pair of torsion springs of valve body 30
58 inwardly facing surface of door 54 of valve body 30
60 deflector of door 54 of valve body 30
61 groove
62 operating surface of deflector 60 of door 54 of valve body 30 for deflecting liquid 22 downwardly when door 54 of valve body 30 is opened
63 arrow
64 backstop of mount 32 for abutting against edge 66 of shelf 68 of differently configured places 26 when dispenser 20 is placed on shelf 68 of differently configured places 26
65 air inlet manifold
66 edge of shelf 68 of differently configured places 26
68 shelf of differently configured places 26
70 linkage of valve body 30
72 trigger of linkage 70 of valve body 30
74 pair of connecting arms of linkage 70 of valve body 30
76 cup
78 stand of mount 32

D. Specific Configuration of Stand 78 of Mount 32.

80 thin wire of stand 78 of mount 32

5. DETAILED DESCRIPTION OF THE PREFERRED EMBODIMENTS

A. General

Referring now to the figures, in which like numerals indicate like parts, and particularly to FIG. 1, which is a diagrammatic perspective view of the dispenser of the embodiments of the present invention, the dispenser of the embodiments of the present invention is shown generally at 20 for a liquid 22 in a container 24 and for mounting to differently configured places 26.

B. The Overall Configuration of the Dispenser 20

The dispenser 20 comprises a support 28, a valve body 30, and a mount 32. The support 28 is for supporting the container 24 in an inverted position. The valve body 30 is operatively connected to the support 28 and is for dispensing the liquid 22 from the container 24 while simultaneously venting air 33 to allow smooth flow of the liquid 22 through the dispenser 20. The mount 32 is operatively connected to the support 28 and is for mounting the dispenser 20 to the differently configured places 26.

C. The Specific Configuration of the Support 28, the Valve Body 30, and the Mount 32

Figure 2:
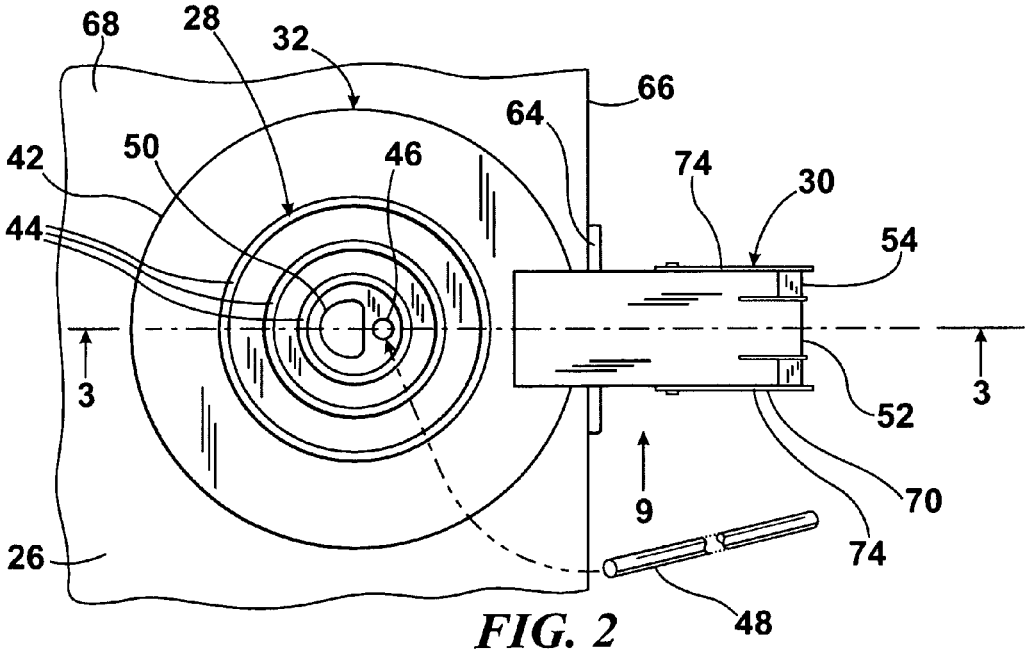
FIG. 2 is an enlarged diagrammatic top plan view taken along LINE 2-2 in FIG. 1.
Figure 3:
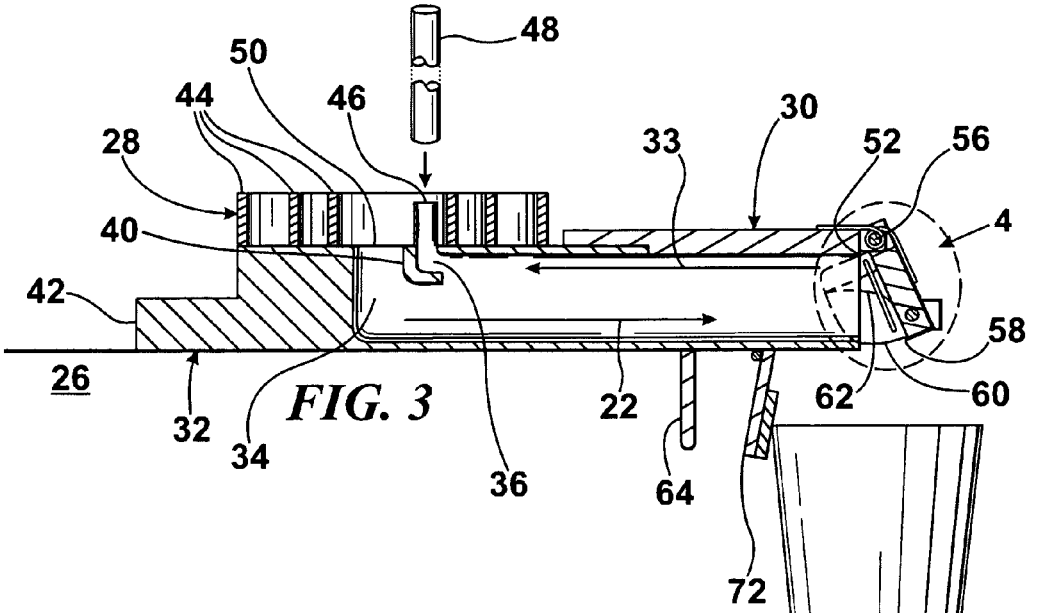
FIG. 3 is a diagrammatic cross sectional view taken along LINE 3-3 in FIG. 2.
Figure 4:
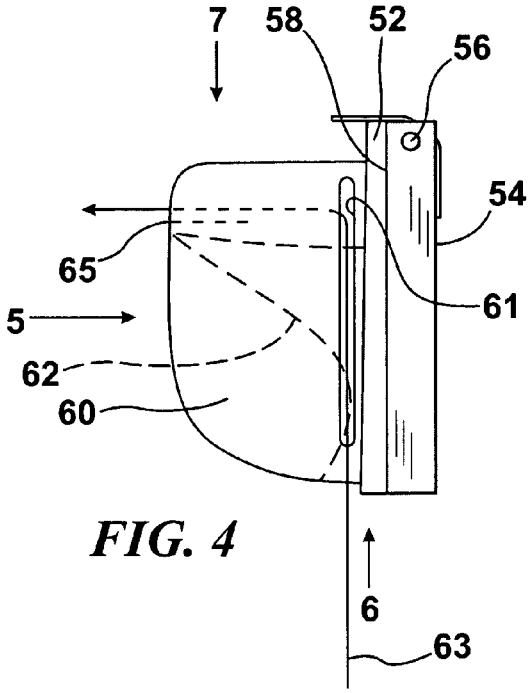
FIG. 4 is an enlarged diagrammatic elevational view of the area generally enclosed by the dotted curve identified by ARROW 4 in FIG. 3.
Figure 5:
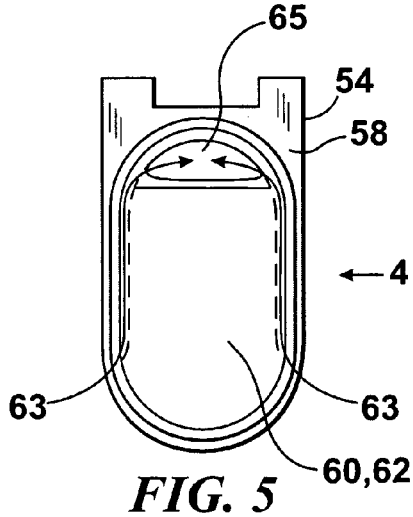
FIG. 5 is a diagrammatic front end view taken generally in the direction of ARROW 5 in FIG. 4.
Figure 6:
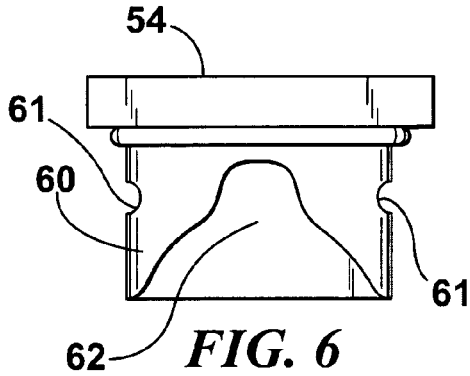
FIG. 6 is a diagrammatic bottom plan view taken generally in the direction of ARROW 6 in FIG. 4.
Figure 7:
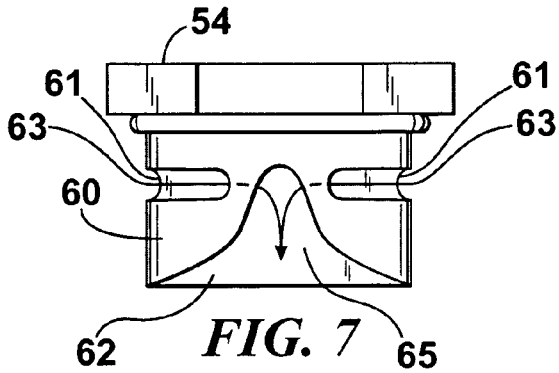
FIG. 7 is a diagrammatic top plan view taken generally in the direction of ARROW 7 in FIG. 4.
Figure 8:
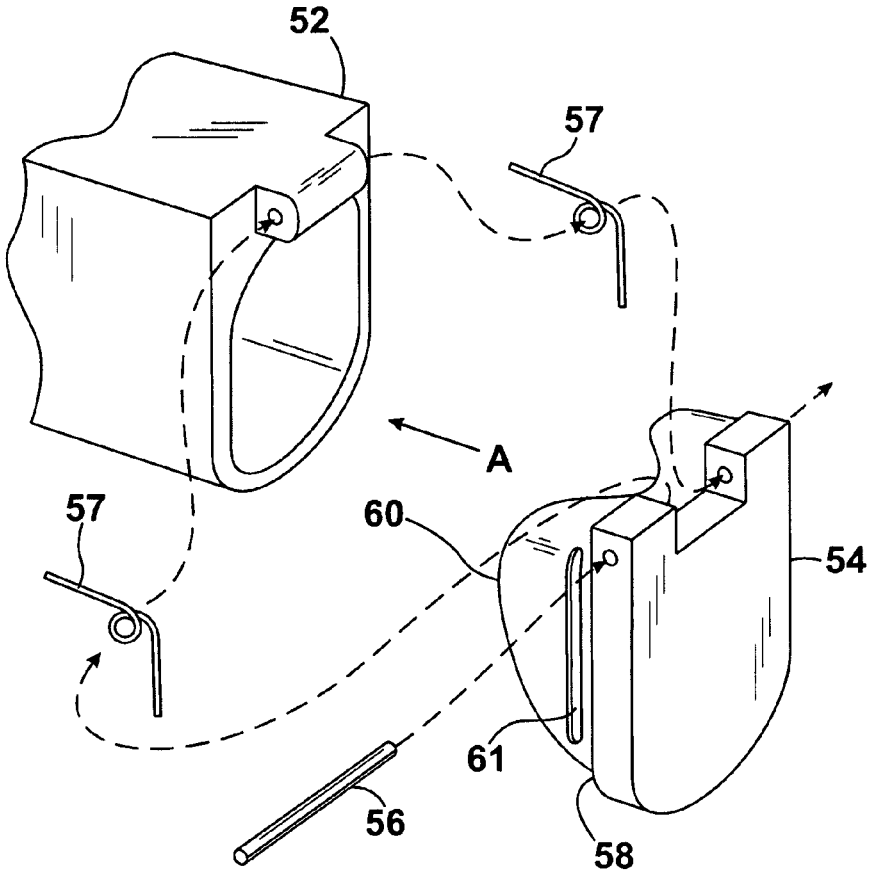
FIG. 8 is an enlarged exploded perspective view of the area generally enclosed by the dotted curve identified by ARROW 8 in FIG. 1.
Figure 9:
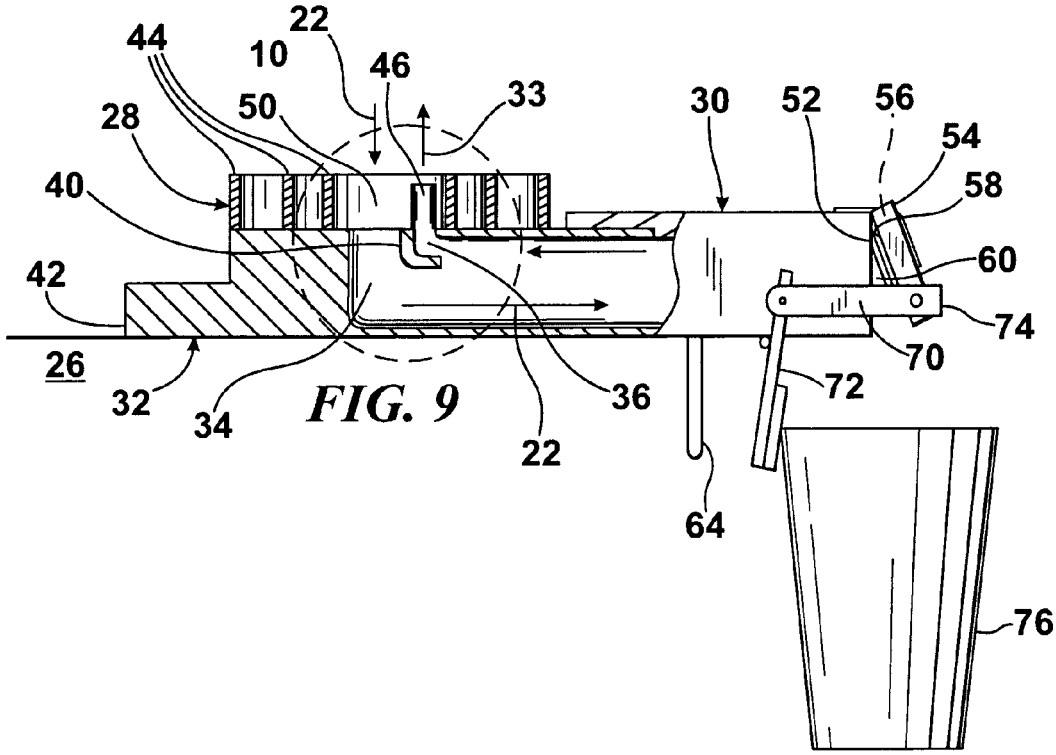
FIG. 9 is a diagrammatic elevational view in partial section taken generally in the direction of ARROW 9 in FIG. 2.
Figure 10:
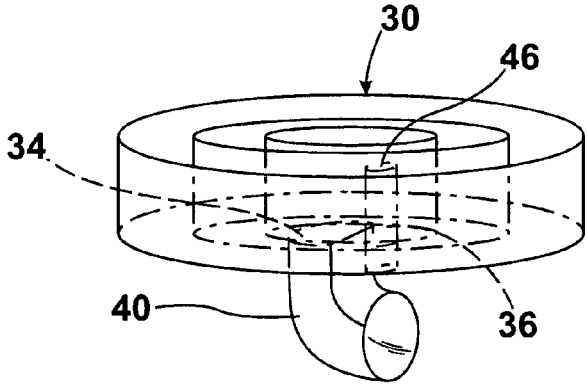
FIG. 10 is an enlarged diagrammatic perspective view of the area generally enclosed by the dotted curve identified by ARROW 10 in FIG. 9.

The specific configuration of the support 28, the valve body 30, and the mount 32 can best be seen in FIGS. 2-10, which are, respectively, an enlarged diagrammatic top plan view taken along LINE 2-2 in FIG. 1, a diagrammatic cross sectional view taken along LINE 3-3 in FIG. 2, an enlarged diagrammatic elevational view of the area generally enclosed by the dotted curve identified by ARROW 4 in FIG. 3, a diagrammatic front end view taken generally in the direction of ARROW 5 in FIG. 4, a diagrammatic bottom plan view taken generally in the direction of ARROW 6 in FIG. 4, a diagrammatic top plan view taken generally in the direction of ARROW 7 in FIG. 4, an enlarged exploded perspective view of the area generally enclosed by the dotted curve identified by ARROW 8 in FIG. 1, a diagrammatic elevational view in partial section taken generally in the direction of ARROW 9 in FIG. 2, and an enlarged diagrammatic perspective view of the area generally enclosed by the dotted curve identified by ARROW 10 in FIG. 9, and as such, will be discussed with reference thereto.

The valve body 30 contains a dispensing chamber 34 and a venting chamber 36. The dispensing chamber 34 in the valve body 30 is for dispensing the liquid 22. The venting chamber 36 in the valve body 30 is for venting the air 33. The dispensing chamber 34 in the valve body 30 and the venting chamber 36 in the valve body 30 are separated from each other by a partition 40.

The mount 32 comprise a base 42. The base 42 of the mount 32 is for mounting the dispenser 20 to the differently configured places 26.

The base 42 of the mount 32 is preferably generally cylindrically shaped.

The support 28 extends above and fluidly communicates with the base 42 of the mount 32.

The support 28 is preferably generally cylindrically shaped.

As best seen in FIG. 2, the support 28 has a plurality of concentric threaded rings 44. The plurality of concentric threaded rings 44 of the support 28 are for threadably receiving threads of the container 24 so as to accommodate different sized containers 24.

The support 28 contains a first through bore 46. The first through bore 46 of the support 28 is preferably generally circular-shaped, positioned off-center in the support 28, fluidly communicates with the venting chamber 36 in the valve body 30, and receives an optional straw 48 via a friction-fit for fluid communication therebetween. The optional straw 48 of the support 28 extends upwardly from the first through bore 46 of the support 28 and is for extending into the container 24 for venting the air 33, if less bubbling is desired as is in the case of carbonated beverages.

The support 28 contains a second through bore 50. The second through bore 50 of the support 28 is disposed behind the first through bore 46 of the support 28, and as such, is preferably generally D-shaped so as not to physically interfere with the first through bore 46 of the support 28 and the optional straw 48 of the support 28 therein, is positioned generally centrally in the support 28, and fluidly communicates the dispensing chamber 34 in the valve body 30 with the liquid 22 in the container 24.

The valve body 30 extends preferably generally radially outwardly from and fluidly communicates with the support 28 to a distal end 52 that is open.

The valve body 30 comprises a door 54. The door 54 of the valve body 30 is pivotally mounted to the distal end 52 of the valve body 30 via a pivot pin 56.

As best seen in FIG. 8, the door 54 of the valve body 30 normally closes the distal end 52 of the valve body 30 via a pair of torsion springs 57.[1] The pair of torsion springs 57 of the valve body 30 operatively receive the pivot pin 56 of the door 54 of the valve body 30 and bias against both the door 54 of the valve body 30 and the distal end 52 of the valve body 30.

[1] A torsion spring is a spring that works by torsion or twisting; that is, a flexible elastic object that stores mechanical energy when it is twisted. The amount of force (actually torque) it exerts is proportional to the amount it is twisted. A torsion spring is often made from a wire, ribbon, or bar of metal or rubber, while more delicate ones are made of silk, glass, or quartz fibers.

The door 54 of the valve body 30 has an inwardly facing surface 58 that has a resilient property so as to provide a fluid tight seal, and a deflector 60. The deflector 60 of the door 54 of the valve body 30 extends from the inwardly facing surface 58 of the door 54 of the valve body 30 into the distal end 52 of the valve body 30.

The deflector 60 of the door 54 of the valve body 30 has an operating surface 62. The operating surface 62 of the deflector 60 of the door 54 of the valve body 30 is shaped for deflecting the liquid 22 downwardly when the door 54 of the valve body 30 is opened.

The deflector 60 has a groove 61 on each side, so as to facilitate a smooth air flow, when the door 54 is opened, as indicated by arrow 63, into an air inlet manifold 65 which is located above the operating surface 62 of the deflector 60.

The mount 32 has a backstop 64. The backstop 64 of the mount 32 is preferably generally plate-like, depends from that portion of the valve body 30 that contains the dispensing chamber 34 of the valve body 30 and the venting chamber 36 of the valve body 30, adjacent to the base 42 of the mount 32, and as shown in FIG. 2, is for abutting against an edge 66 of a shelf 68 of the differently configured places 26 when the dispenser 20 is placed on the shelf 68 of the differently configured places 26.

As shown in FIG. 9, the valve body 30 has a linkage 70. The linkage 70 of the valve body 30 opens the door 54 of the valve body 30 for dispensing the liquid 22.

The linkage 70 of the valve body 30 comprises a trigger 72 and a pair of connecting arms 74. The trigger 72 of the linkage 70 of the valve body 30 depends from and is pivotally connected to just inward of the distal end 52 of the valve body 30. The pair of connecting arms 74 of the linkage 70 of the valve body 30 straddle the distal end 52 of the valve body 30 and are pivotally connected to both the trigger 72 of the linkage 70 of the valve body 30 and the door 54 of the valve body 30, and as such, when the trigger 72 of the linkage 70 of the valve body 30 is pivoted inwardly by a cup 76, the pair of connecting arms 74 of the linkage 70 of the valve body 30 are pushed outwardly thereby pivoting the door 54 of the valve body 30 open, with the liquid 22 then exiting the container 24 via the second through bore 50 of the support 28 into the dispensing chamber 34 of the valve body 30, then out the distal end 52 of the valve body 30, and against the operating surface 62 of the deflector 60 of the door 54 of the valve body 30 to be deflected downwardly into the cup 76.

The mount 32 comprises an optional stand 78.

D. The Specific Configuration of the Stand 78 of the Mount 32

Figure 11:
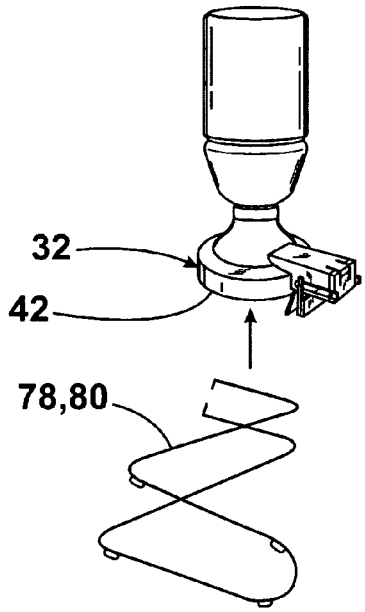
FIG. 11 is an exploded diagrammatic perspective view of the dispenser of the present invention shown in FIG. 1 with an auxiliary stand.
Figure 12:
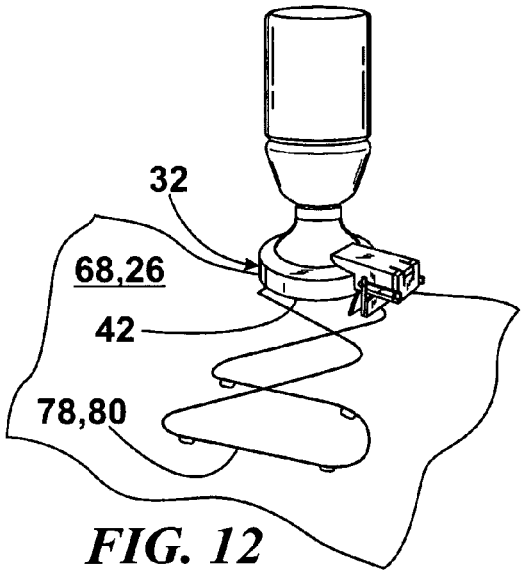
FIG. 12 is a diagrammatic perspective view of one embodiment of the auxiliary stand of the dispenser of the present invention shown in FIG. 11.
Figure 13:
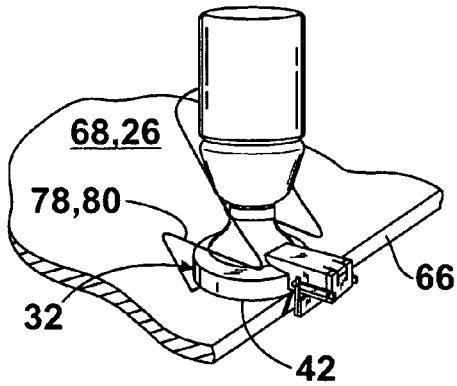
FIG. 13 is a diagrammatic perspective view of another embodiment of the auxiliary stand of the dispenser of the present invention shown in FIG. 11.

The specific configuration of the stand 78 of the mount 32 can best be seen in FIGS. 11-13, which are, respectively, an exploded diagrammatic perspective view of the dispenser of the present invention shown in FIG. 1 with an auxiliary stand, a diagrammatic perspective view of one embodiment of the auxiliary stand of the dispenser of the present invention shown in FIG. 11, and a diagrammatic perspective view of another embodiment of the auxiliary stand of the dispenser of the present invention shown in FIG. 11, and as such, will be discussed with reference thereto.

As shown in FIG. 11, the stand 78 of the mount 32 pivotally depends from the base 42 of the mount 32. The stand 78 of the mount 32 comprises of a thin wire 80 with minimal flexibility. The stand 78 of the mount 32 is bent into a shape that allows it to have, as shown in FIG. 12, an extended position where the dispenser 20 can rest on a flat surface 82 of the differently configured places 26 and, as shown in FIG. 13, a retracted position where the dispenser 20 can rest against the edge 66 of the shelf 68 of the differently configured places 26.

E. The Conclusions

It will be understood that each of the elements described above or two or more together may also find a useful application in other types of constructions differing from the types described above.

While the embodiments of the present invention have been illustrated and described as embodied in a dispenser for liquids in a container and for mounting to differently configured places, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A dispenser for a liquid in a container and for mounting to differently configured places, comprising:

a) a support;

b) a valve body; and c) a mount;

wherein said support is for supporting the container in an inverted position;

wherein said valve body is operatively connected to said support;

wherein said valve body is for dispensing the liquid from the container while simultaneously venting air to allow smooth flow of the liquid through said dispenser;

wherein said mount is operatively connected to said support; and wherein said mount is for mounting said dispenser to the differently configured places;

wherein said valve body contains:

d) a dispensing chamber; and e) a venting chamber;

wherein said dispensing chamber in said valve body is for dispensing the liquid;

wherein said venting chamber in said valve body is for venting the air; and wherein said dispensing chamber in said valve body and said venting chamber in said valve body are separated from each other by a partition;

wherein said support contains a first through bore;

wherein said first through bore of said support is generally circular-shaped;

wherein said first through bore of said support is positioned off-center in said support;

wherein said first through bore of said support fluidly communicates with said venting chamber in said valve body;

wherein said first through bore of said support receives a straw via a friction-fit and fluidly communicates therebetween;

wherein said straw of said support extends upwardly from said first through bore of said support; and wherein said straw of said support is for extending into the container for venting the air;

wherein said support contains a second through bore; and wherein said second through bore of said support is disposed behind said first through bore of said support, and as such, is generally D-shaped so as not to physically interfere with said first through bore of said support and said straw of said support, is positioned generally centrally in said support, and is for fluidly communicating said dispensing chamber in said valve body with the liquid in the container;

wherein said valve body extends generally radially outwardly from said support to a distal end thereof;

wherein said valve body fluidly communicates with said support; and wherein said distal end of said valve body is open;

wherein said valve body comprises a door; and wherein said door of said valve body is pivotally mounted to said distal end of said valve body via a pivot pin;

wherein said door of said valve body has:

f) an inwardly facing surface; and g) a deflector;

wherein said deflector of said door of said valve body extends from said inwardly facing surface of said door of said valve body into said distal end of said valve body;

wherein said deflector of said door of said valve body has an operating surface; and wherein said operating surface of said deflector of said door of said valve body is shaped for deflecting the liquid downwardly when said door of said valve body is opened;

wherein said valve body has a linkage; and wherein said linkage of said valve body opens said door of said valve body for dispensing the liquid;

wherein said linkage of said valve body comprises:

h) a trigger; and i) a pair of connecting arms;

wherein said pair of connecting arms of said linkage of said valve body straddle said distal end of said valve body; and wherein said pair of connecting arms of said linkage of said valve body are pivotally connected to both said trigger of said linkage of said valve body and said door of said valve body, and as such, when said trigger of said linkage of said valve body is pivoted inwardly by a cup, said pair of connecting arms of said linkage of said valve body are pushed outwardly thereby pivoting said door of said valve body open, with the liquid then exiting the container via said second through bore of said support into said dispensing chamber of said valve body, out said distal end of said valve body, and against said operating surface of said deflector of said door of said valve body to be reflected downwardly into the cup.

2. The dispenser of claim 1, wherein said support is generally cylindrically shaped.

3. The dispenser of claim 1, wherein said support has a plurality of concentric threaded rings; and wherein said plurality of concentric threaded rings of said support are for threadably receiving threads of the container so as to accommodate different sized containers.

4. The dispenser of claim 1, wherein said door of said valve body normally closes said distal end of said valve body via a pair of torsion springs;

wherein said pair of torsion springs of said valve body operatively receive said pivot pin of said door of said valve body; and wherein said pair of torsion springs of said valve body bias against both said door of said valve body and said distal end of said valve body.

5. The dispenser of claim 1, wherein said trigger of said linkage of said valve body depends from said distal end of said valve body; and wherein said trigger of said linkage of said valve body is pivotally connected to just inward of said distal end of said valve body.

6. A dispenser for a liquid in a container and for mounting to differently configured places, comprising:

a) a support;

b) a valve body; and c) a mount;

wherein said support is for supporting the container in an inverted position;

wherein said valve body is operatively connected to said support;

wherein said valve body is for dispensing the liquid from the container while simultaneously venting air to allow smooth flow of the liquid through said dispenser;

wherein said mount is operatively connected to said support;

wherein said mount is for mounting said dispenser to the differently configured places, wherein said valve body contains:

d) a dispensing chamber; and e) a venting chamber;

wherein said dispensing chamber in said valve body is for dispensing the liquid;

wherein said venting chamber in said valve body is for venting the air; and wherein said dispensing chamber in said valve body and said venting chamber in said valve body are separated from each other by a partition:

wherein said mount comprise a base; and wherein said base of said mount is for mounting said dispenser to the differently configured places;

wherein said mount has a backstop;

wherein said backstop of said mount is generally plate-like;

wherein said backstop of said mount depends from that portion of said valve body that contains said dispensing chamber of said valve body and said venting chamber of said valve body;

wherein said backstop of said mount is adjacent to said base of said mount; and wherein said backstop of said mount is for abutting against an edge of a shelf of the differently configured places when said dispenser is placed on the shelf of the differently configured places;

wherein said mount comprises a stand;

wherein said stand of said mount pivotally depends from said base of said mount;

wherein said stand of said mount comprises a thin wire;

wherein said thin wire of said stand of said mount has minimal flexibility; and wherein said stand of said mount is bent into a shape that allows it to have an extended position where said dispenser can rest on a flat surface of the differently configured places and a retracted position where said dispenser can rest against the edge of the shelf of the differently configured places.

7. The dispenser of claim 6, wherein said support is generally cylindrically shaped.

8. The dispenser of claim 6, wherein said support has a plurality of concentric threaded rings; and wherein said plurality of concentric threaded rings of said support are for threadably receiving threads of the container so as to accommodate different sized containers.

9. The dispenser of claim 6, wherein said base of said mount is generally cylindrically shaped.

10. The dispenser of claim 6, wherein said support extends above said base of said mount; and wherein said support fluidly communicates with said base of said mount.

* * * * *